US006899583B2

(12) United States Patent
Barden

(10) Patent No.: US 6,899,583 B2
(45) Date of Patent: May 31, 2005

(54) INFLATABLE BUOY

(76) Inventor: Wayne Barden, 101-104 Albert Street, Eagleby, Queensland (AU), 4207

( * ) Notice: Subject to any disclaimer, the term of this patent is extended or adjusted under 35 U.S.C. 154(b) by 0 days.

(21) Appl. No.: 10/474,509

(22) PCT Filed: Apr. 4, 2002

(86) PCT No.: PCT/AU02/00432

§ 371 (c)(1),
(2), (4) Date: Oct. 22, 2003

(87) PCT Pub. No.: WO02/081300

PCT Pub. Date: Oct. 17, 2002

(65) Prior Publication Data

US 2004/0142613 A1 Jul. 22, 2004

(30) Foreign Application Priority Data

Apr. 5, 2001 (AU) ..... PR4230

(51) Int. Cl.[7] ..... B63C 9/08
(52) U.S. Cl. ..... 441/89
(58) Field of Search ..... 441/80, 88, 89

(56) References Cited

U.S. PATENT DOCUMENTS

| | | | | |
|---|---|---|---|---|
| 3,721,983 A | | 3/1973 | Sherer | |
| 4,224,707 A | | 9/1980 | Mariani | |
| 4,295,438 A | | 10/1981 | Porter | |
| 5,114,369 A | * | 5/1992 | Coffey | 441/11 |
| 5,326,297 A | | 7/1994 | Loughlin | |
| 5,738,557 A | | 4/1998 | Biesecker | |
| 5,823,840 A | | 10/1998 | Powers | |
| 6,032,607 A | * | 3/2000 | Ashline | 116/210 |
| 6,164,239 A | | 12/2000 | Dawson | |

FOREIGN PATENT DOCUMENTS

| | | |
|---|---|---|
| AU | 751939 | 1/2001 |
| DE | 39 05 225 A1 | 8/1990 |
| DE | 44 45 885 | 7/1996 |
| EP | 0 223 321 | 5/1987 |
| EP | 0 240 468 | 10/1987 |
| FR | 2 543 713 | 10/1984 |
| FR | 2 543 714 | 10/1984 |
| FR | 2 596 657 | 10/1987 |
| FR | 2 727 380 | 5/1996 |
| GB | 2 029 332 A | 3/1980 |
| GB | 2 246 745 A | 2/1992 |
| GB | 2 354 488 A | 3/2001 |
| JP | 57060994 | 4/1982 |
| JP | 10307972 | 11/1998 |
| WO | WO 96/23692 | 8/1996 |

* cited by examiner

*Primary Examiner*—Stephen Avila
(74) *Attorney, Agent, or Firm*—Hoffman, Wasson & Gitler

(57) ABSTRACT

An inflatable buoy (20) that may be worn by a person, such as a swimmer, and used as a flotation aid and beacon in an emergency situation. The buoy (20) has securing means (2*a*) for being secured to a forearm (3) of a person, an inflatable balloon (4*a*) that when uninflated is disposed on the securing means (2*a*) and when inflated is separate from the securing means (2*a*), a tether (7*a*) anchoring the balloon (4*a*) to the securing means (2*a*), and a gas dispenser (30*a*) that, when activated, inflates the balloon (4*a*) with gas. The buoy (20) also has a pair of handles (21) for gripping by a person as well as a pop-up flag (22). In another embodiment of the invention, the buoy may be used as an air beacon whereby the balloon is filled with gas that is lighter than air and the balloon can float to a height determined by the length of the tether.

19 Claims, 2 Drawing Sheets

INFLATABLE BUOY

TECHNICAL FIELD

This invention relates to an inflatable buoy for use as a beacon. In particular, the invention concerns a buoy that may be worn by a person and inflated in an emergency situation.

The invention has been developed primarily for use as a personal safety aid and will therefore be described in this context. It is to be appreciated, however, that the inflatable buoy may have other uses.

BACKGROUND ART

Surf beaches claim many lives each year. Generally speaking, people drown because they overestimate their abilities in the surf and underestimate the inherent dangers of the surf. From time to time, people also drown on beaches and very near to beaches patrolled by lifeguards. This happens because it is not always possible to sight a drowning person, particularly if the surf is choppy or if the person is far from shore and their cries for help are inaudible.

In many if not most instances, persons might have been saved from drowning if only they had with them a flotation aid of sorts or if only they had been sighted by a nearby person sooner. Sometimes it comes down to a matter of minutes whether a person drowning will live or die.

There are many reasons as to why people do not carry flotation aids or beacons of sorts (ie. visual signals for attracting attention) with them into the surf. Such aids or beacons, for instance, may not be commercially available, or may be unfashionable, or may be thought to be unnecessary, or may be a source of discomfort or inconvenience when swimming in the surf, particularly if such an aid or beacon is not in a compact form. Needless to say, swimming in the surf would be less enjoyable if one had to swim with an inflated flotation aid, such as a life buoy, continuously in tow.

Each year, search rescue teams are sent by air or on foot in search of persons lost in wilderness regions. Such persons, eg. hikers, become lost or stranded for a plethora of reasons, and in many instances such persons are not equipped with a beacon of sorts (eg. flare) to alert rescuers as to their position.

There are many reasons as to why people do not carry beacons of sorts with them when exploring wilderness regions. Such beacons, for instance, may not be commercially available, or may be expensive to purchase, or may be thought to be unnecessary, or may be a source of discomfort or inconvenience (adding weight and volume to the load already being carried), particularly if the beacon is not in a compact form.

It would be advantageous to have a beacon of sorts that could be worn by a person, whether for swimming or for hiking, that provides little discomfort or inconvenience to the wearer.

It is an object of the present invention to provide an inflatable buoy that meets at least one of the advantages stated above.

DISCLOSURE OF INVENTION

According to the present invention there is provided an inflatable buoy for use as a beacon, said buoy having:

securing means for securing the buoy to an object;

an inflatable balloon that when uninflated is disposed on the securing means and when inflated is separate from the securing means;

a tether anchoring the balloon to the securing means; and a gas dispenser that, when activated, inflates the balloon.

Preferably, the inflatable buoy functions as a personal safety aid for use in an emergency situation, with the securing means adapted to secure about a forearm or wrist of a person. The securing means may comprise a flexible or rigid band, strap, bracelet or the like and may consist of, for instance, cloth, rubber, plastics material or leather. Preferably, the securing means comprises a press on-tear off fastening (Velcro®) strap having ends that can mate with one another.

The uninflated balloon may be disposed on the securing means in any number of ways. For instance, the balloon and the securing means may have respective formations that mate when the balloon is uninflated and mate to a lesser extent when the balloon has been inflated such that the balloon may detach the securing means. Preferably, one or more press on-tear off fastening (Velcro®) patches are adhered to the balloon and provide the formations that can mate with formations of the press on-tear off fastening (Velcro®) strap securing means.

The tether preferably comprises a line or cord that has high strength but little weight and thickness. In one embodiment, the tether may be a nylon fishing line. At least part of the tether may be stored in a wound state between the uninflated balloon and the securing means. In one embodiment, the tether may be wound about a spool which is located between the securing means and the balloon.

The balloon is preferably made of rubber and is brightly coloured so that it stands out from its surroundings, ie. serving as a beacon. The balloon may be comprised of material for detection by radar.

Preferably, the gas dispenser is disposed on the balloon and includes a canister of compressed gas or chemicals for generating gas, a tube extending between the canister and the balloon, and a valve that when opened enables the balloon to be filled with gas. The canister may contain, for instance, helium, carbon dioxide or air, depending on whether the balloon is to float on air or on water. Alternatively, the gas of the gas dispenser may be generated chemically. For instance, carbon dioxide may be generated by mixing calcium carbonate or sodium carbonate with acid in the canister.

If the inflatable buoy is to be used as an air beacon, then the balloon is filled with gas that is lighter than air and the balloon can float to a height determined by the length of the tether.

The gas dispenser may be activated using any suitable mechanism known to persons skilled in the art. Preferably, a pull-string mechanism having a string and a release trigger is used, whereby the valve of the gas dispenser is opened when the string is pulled. Alternatively, the valve may be turned to an open position by hand or using a lever of sorts.

The inflatable buoy may have a cover attached to the balloon that shields the uninflated balloon. The cover may safeguard the balloon from being punctured by accident. The cover may comprise moulded rubber or plastics material. The cover may also house the gas dispenser and hold the dispenser against the balloon. Preferably, the cover comprises a flexible disc that is adhered to the balloon and which has a raised central portion that houses the gas dispenser. The string-pull mechanism may be disposed on the cover.

One end of the tether may be anchored to the securing means and the other end may be anchored to the cover.

If the buoy is to be used as a flotation aid, then the buoy may further have one or more handles extending from the balloon for gripping by a person. At least one handle may extend from the cover, but preferably, two handles extend from the cover either side of the gas dispenser.

A flag may extend from the balloon when the balloon has been inflated. The flag may be stored in a collapsed, compressed or folded state between the uninflated balloon and the securing means. For instance, the flag may have a flexibly resilient mast which extends away from the balloon when released from confinement between the securing means and the uninflated balloon. The flag may be brightly coloured and may serve as a beacon to others that the person is in danger. The flag may be situated so that it will extend upright (i.e. at the balloon's apex) when the handles of the cover are being held by a person.

Optionally, the cover and/or the securing strap may have other safety devices such as, for instance, an audible or visual electronic alarm.

MODES FOR CARRYING OUT THE INVENTION

Figure 3:
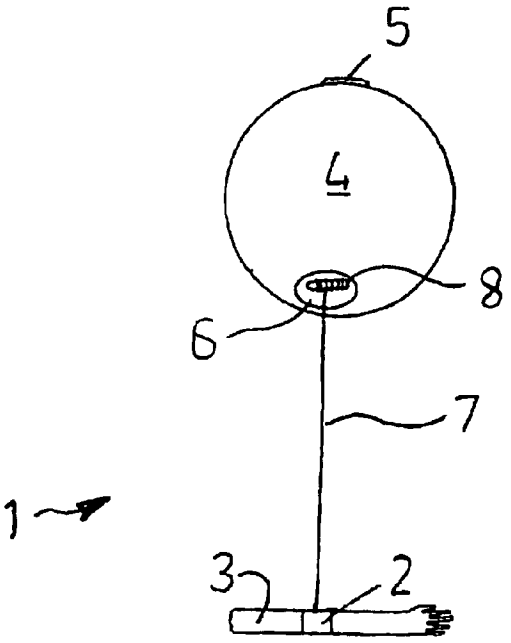
FIG. 3 shows the buoy of FIG. 1 as used in an emergency situation.

In all of the drawings like reference numerals refer to like parts.

Figure 2:
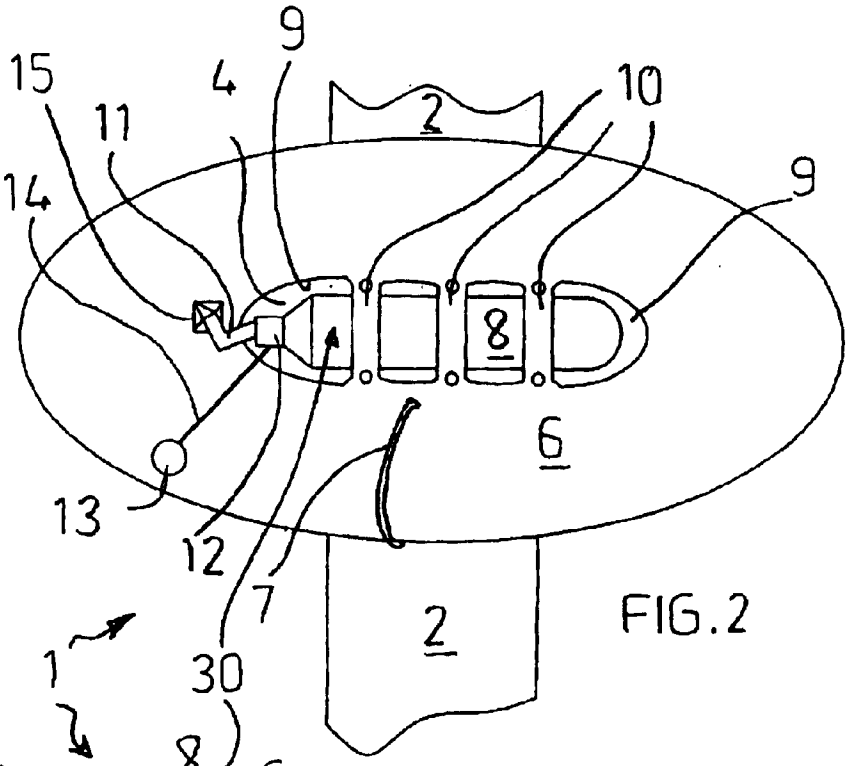
FIG. 2 is a top plan view of the buoy of FIG. 1.
Figure 1:
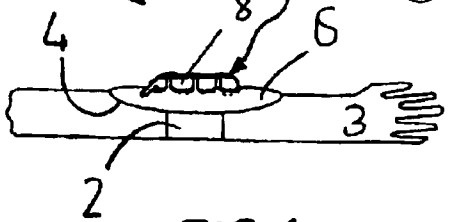
FIG. 1 is a side elevation view of an inflatable buoy for use as an air beacon, the buoy being strapped to an arm of a person, according to an embodiment of the invention.

Referring first to FIGS. 1–3, there is shown an inflatable buoy 1 that may be worn by a person, such as a hiker, and used as an air beacon in an emergency situation. The buoy 1 has securing means 2 for being secured to a forearm 3 of a person, an inflatable balloon 4 that when uninflated is disposed on the securing means 2 and when inflated is separate from the securing means 2, a tether 7 anchoring the balloon 4 to the securing means 2, and a gas dispenser 30 that, when activated, inflates the balloon 4 with gas.

The balloon 4 and the securing means 2 have respective formations that mate when the balloon 4 is uninflated and mate to a lesser extent when the balloon 4 has been inflated such that the inflated balloon 4 can readily detach the securing means 2. The securing means 2 is a press on-tear off fastening (Velcro®) strap 2 adapted to wrap around a forearm of a person and having ends that can mate with one another. A press on-tear off fastening (Velcro®) patch 5 is adhered to the balloon 4 and provides the formations that can mate with formations of the strap 2. The formations are typical Velcro® hooks and loops.

The buoy 1 has a cover 6 comprising a flexible moulded rubber disc that is adhered to the balloon 4. A raised central portion of the cover 6 houses the gas dispenser 30. The cover 6 safeguards the uninflated balloon 4 from being punctured by accident. Three tamper-proof mounting straps 10 of the raised central portion hold the dispenser 30 against the balloon 4.

The tether 7 comprises a nylon cord 7 and has an end tied to the securing strap 2 and an end tied to the cover 6. Most of the tether 7 is stored in a wound state between the uninflated balloon 4 and the securing means 2.

The gas dispenser 30 is disposed on the balloon 4 and includes a canister 8 of compressed gas or chemicals for generating gas, a tube 11 extending between the canister 8 and the balloon 4, and a valve 12 that when opened enables the balloon 4 to be filled with gas. The canister 8 of FIGS. 1–3 contains helium so that the balloon 4 can float on air. The balloon 4 can float to a height determined by the length of the tether 7.

A pull-string mechanism, having a string 14 and a release trigger 13, is used to activate the gas dispenser 30. The release trigger 13 is attached to the cover 6 and the string 14 is strung between the release trigger 13 and the valve 12. The valve 12 is opened when string 14 is pulled.

The balloon 4 is made of rubber and is brightly coloured so that it stands out from its surroundings.

In use, the buoy 1 is worn on a person's forearm. In an emergency situation, string 14 is pulled by the wearer, the balloon 4 fills with helium gas and as the balloon 4 becomes rounded the patch 5 breaks contact with formations of the securing means 2, and the balloon 4 floats up into the air to a height determined by the length of the tether 7. As the balloon 4 is brightly coloured, it may be easily sighted by, say, rescuers.

Figure 6:
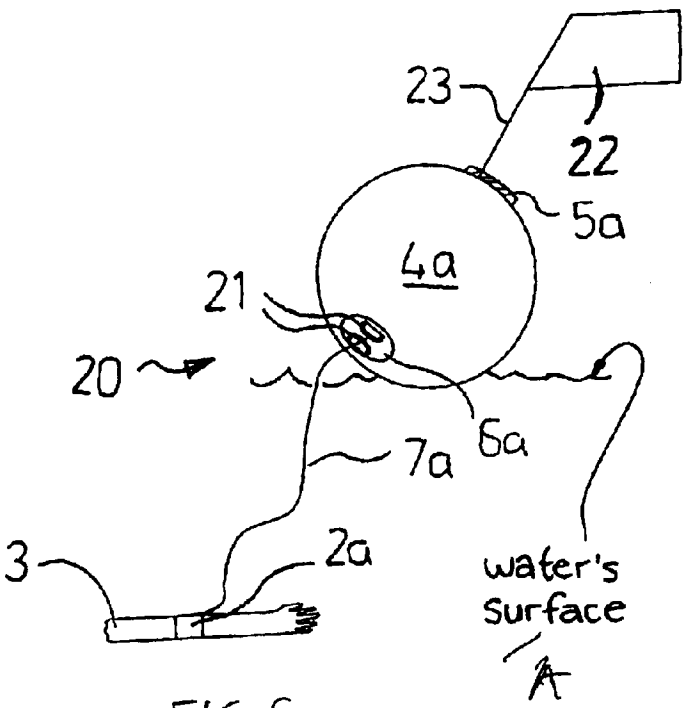
FIG. 6 shows the buoy of FIG. 4 as used in an emergency situation.
Figure 5:
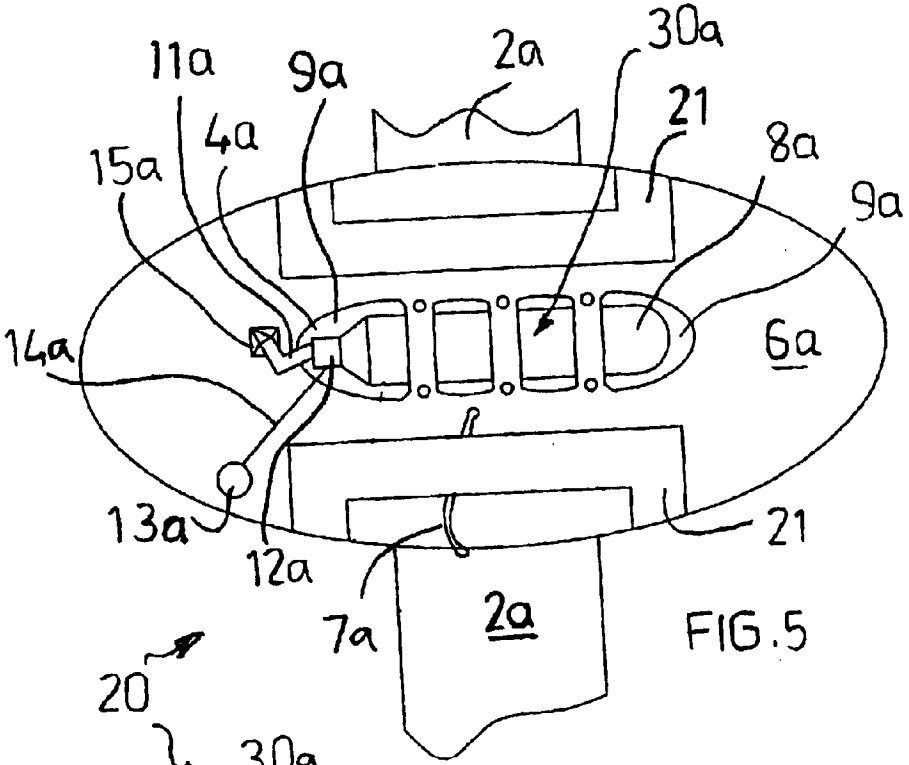
FIG. 5 is a top plan view of the buoy of FIG. 4.
Figure 4:
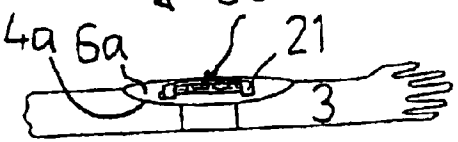
FIG. 4 is a side elevation view of an inflatable buoy for use as a flotation aid and beacon, the buoy being strapped to an arm of a person, according to an embodiment of the invention.

FIGS. 4–6 show an inflatable buoy 20 that may be worn by a person swimming and used as a flotation aid and beacon in an emergency situation. The buoy 20 has nearly all of the features of the buoy 1 of FIGS. 1–3, as indicated by like numerals, except that the numerals of FIGS. 4–6 end with an "a".

The differences of buoy 20 from buoy 1 will now be addressed. The canister 8*a* of buoy 20 contains carbon dioxide or compressed air instead of helium, as the balloon 4*a* floats on water. Two moulded handles 21 extend from the cover 6 and can be held onto by the person drowning after the balloon 4*a* has been inflated. A pop-up brightly coloured flag 22 extends from the inflated balloon 4*a* to attract the attention of nearby persons. The flag 22 has a flexibly resilient mast 23 which, prior to inflation of the balloon 4*a*, is trapped between the balloon 4*a* and the securing means 2*a*.

In use, the buoy 20 is strapped to a forearm 3 of a swimmer and if the swimmer requires assistance, string 14*a* is pulled, the balloon 4*a* inflates and detaches from the securing strap 2*a* and floats on the water's surface. The tether 7*a* anchors the balloon 4*a* to the strap 2*a* and ensures that the balloon 4*a* cannot float out of the swimmer's reach. Once the balloon 4*a* has inflated, the swimmer holds onto the handles 21 and waits for help. When the handles 21 are held, the balloon 4*a* turns such that the flag 22 is upwardly directed. The balloon 4*a* and flag 22 may be easily sighted by persons nearby.

Prior to being inflated, the buoy 1, 20 is quite compact and may be worn without inconveniencing or causing much discomfort to the wearer, and when used in an emergency situation, the inflated balloon 4, 4*a* is of considerable size may be readily sighted.

What is claimed is:

1. An inflatable buoy for use as a beacon, said buoy having:

securing means for securing the buoy to an object;

an inflatable balloon that when uninflated is disposed on the securing means and when inflated is separate from the securing means;

a tether anchoring the balloon to the securing means;

a gas dispenser that, when activated, inflates the balloon; and a cover attached to the balloon that shields the uninflated balloon, wherein at least one handle extends from the cover and is adapted to be gripped by a person.

2. The inflatable buoy of claim 1, wherein the securing means is adapted to secure about a forearm or wrist of a person.

3. The inflatable buoy of claim 1, wherein the balloon and the securing means have respective formations that mate when the balloon is uninflated and mate to a lesser extent when the balloon has been inflated.

4. The inflatable, buoy of claim 1, wherein at least part of the tether is stored in a wound state between the uninflated balloon and the securing means.

5. The inflatable buoy of claim 1, wherein the gas dispenser is disposed on the balloon.

6. The inflatable buoy of claim 1, wherein the cover houses the gas dispenser and holds the dispenser against the balloon.

7. The inflatable buoy of claim 6, wherein the gas dispenser includes a canister of compressed gas or chemicals for generating gas, a tube extending between the canister and the balloon, and a valve that when opened enables the balloon to be filled with gas.

8. The inflatable buoy of claim 7 further having a pull-string mechanism for opening the valve.

9. An inflatable buoy for use as a beacon, said buoy having:

securing means for securing the buoy to an object;

an inflatable balloon that when uninflated is disposed on the securing means and when inflated is separate from the securing means;

a tether anchoring the balloon to the securing means;

a gas dispenser that, when activated, inflates the balloon, a cover attached to the balloon that shields the uninflated balloon, the cover houses the gas dispenser and holds the dispenser against the balloon, wherein the cover comprises a flexible disc that is adhered to the balloon and the disc has a raised central portion that houses the gas dispenser.

10. The inflatable buoy of claim 1, wherein one end of the tether is anchored to the securing means and the other end is anchored to the cover.

11. The inflatable buoy of claim 1, wherein the tether comprises a cord.

12. The inflatable buoy of claim 8, wherein the pull-string mechanism is disposed on the cover.

13. The inflatable buoy of claim 3, wherein the securing means comprises a press on-tear off fastening strap having ends that can mate with one another.

14. The inflatable buoy of claim 13, wherein one or more press on-tear off fastening patches are adhered to the balloon and provide the formations that can mate with formations of the press on-tear off fastening strap of the securing means.

15. The inflatable buoy of claim 1, wherein two said handles extend from the cover either side of the gas dispenser.

16. The inflatable buoy of claim 1 further having a flag extending from the balloon when the balloon has been inflated.

17. The inflatable buoy of claim 16, wherein the flag is contained in a collapsed state between the uninflated balloon and the securing means.

18. The inflatable buoy of claim 17, wherein the flag has a flexible mast which extends away from the balloon when released from confinement between the uninflated balloon and the securing means.

19. The inflatable buoy of claim 7, wherein the gas renders the balloon floatable on air.

* * * * *